US008091154B2

(12) United States Patent
Allen et al.

(10) Patent No.: US 8,091,154 B2
(45) Date of Patent: Jan. 10, 2012

(54) TOILET SEAT ASSEMBLY

(76) Inventors: Jeffrey Allen, Norfolk (GB); Paul Bartholomew Ravenhill, Norfolk (GB)

( * ) Notice: Subject to any disclaimer, the term of this patent is extended or adjusted under 35 U.S.C. 154(b) by 1056 days.

(21) Appl. No.: 11/575,275

(22) PCT Filed: Sep. 14, 2005

(86) PCT No.: PCT/GB2005/003565

§ 371 (c)(1),
(2), (4) Date: Dec. 17, 2007

(87) PCT Pub. No.: WO2006/030222

PCT Pub. Date: Mar. 23, 2006

(65) Prior Publication Data

US 2008/0276358 A1 Nov. 13, 2008

(30) Foreign Application Priority Data

Sep. 15, 2004 (GB) ..... 0420565.4

(51) Int. Cl.
*A47K 13/12* (2006.01)

(52) U.S. Cl. ..... 4/240; 4/234; 4/237; 4/243.1

(58) Field of Classification Search ..... 4/234, 236–237, 4/240, 242.1, 243.1
See application file for complete search history.

(56) References Cited

U.S. PATENT DOCUMENTS

| | | | | |
|---|---|---|---|---|
| 1,718,485 | A * | 6/1929 | O'Sullivan | 425/12 |
| 3,334,361 | A | 8/1967 | Watson | |
| 3,590,401 | A * | 7/1971 | Brown | 4/236 |
| 3,790,969 | A * | 2/1974 | Waldon | 4/236 |
| 3,802,000 | A * | 4/1974 | Waldon | 4/236 |
| 4,345,607 | A * | 8/1982 | Contreras et al. | 49/386 |
| 5,450,633 | A * | 9/1995 | Semmler | 4/236 |
| 5,608,921 | A * | 3/1997 | Barrett et al. | 4/239 |
| 5,749,104 | A * | 5/1998 | Evans | 4/239 |
| 6,243,884 | B1 * | 6/2001 | Simonson | 4/236 |

FOREIGN PATENT DOCUMENTS

| | | |
|---|---|---|
| AU | 458769 | 3/1975 |
| EP | 1452117 | 9/2004 |
| FR | 2702360 | 9/1994 |
| GB | 922795 | 4/1963 |

OTHER PUBLICATIONS

Intl Search Rep, Dec. 1, 2005, WIPO.
Written Opinion, Dec. 1, 2005, WIPO.
Search/Exam Rep, Jan. 27, 2005, UK Patent Office.

* cited by examiner

*Primary Examiner* — Gregory Huson
*Assistant Examiner* — Karen L Younkins
(74) *Attorney, Agent, or Firm* — GableGotwals

(57) ABSTRACT

A toilet seat assembly comprising a seat (2) and hinge means (5) for hingedly attaching the seat (2) to a toilet. The hinge means (5) comprises a mounting block (50) having an arcuate slot (17), and an arcuate seat tang (20) extends rearwardly of the seat which is slidable in the arcuate slot of the mounting block. The assembly may also comprise a lid (3); and hinge means for hingedly attaching the lid (3) to a toilet; and an arcuate lid tang (23) extending rearwardly of the lid which is also slidable in the arcuate slot (17) of the mounting block (50).

16 Claims, 5 Drawing Sheets

TOILET SEAT ASSEMBLY

The present invention relates to a toilet seat assembly and to a toilet seat and lid assembly. Each assembly includes a hinge for attaching the seat and the lid to a toilet. The invention relates in particular to a toilet seat and lid which are easily detachable, which reduce the build up of dirt, and are also easy to maintain in a clean condition.

Toilet seats and lids, and hinges for attaching them to toilets, are well known in the art, for example in WO02/074149. However, known apparatus has the disadvantage that the hinge, seat and lid form a number of crevices and recesses which can trap dirt. In particular, this is a particular problem for hinges consisting of a rod which rotates in a bearing. The bearing forms a trap for dirt, which cannot be easily cleaned. This may result in the toilet being unhygienic. The toilet seats and lids of the prior art are typically connected to a toilet by a hinge which does not allow easy detachment of the seat and lid.

The present invention provides, a toilet seat assembly comprising a seat; and hinge means for hingedly attaching the seat to a toilet; wherein: the hinge means comprises: a mounting block having an arcuate slot; an arcuate seat tang extending rearwardly of the seat which is slidable in the arcuate slot of the mounting block.

Thus, the present invention solves the hygiene problems of the prior art by providing a hinge which both allows easy detachment of the seat and lid from the toilet and also easy cleaning. Furthermore, when in the down position thereof both seat and lid are securely attached to the toilet and also they are designed to trap relatively little dirt.

A preferred embodiment of the present invention will now be described, by way of example only, with reference to the accompanying figures, in which.

Figure 1:
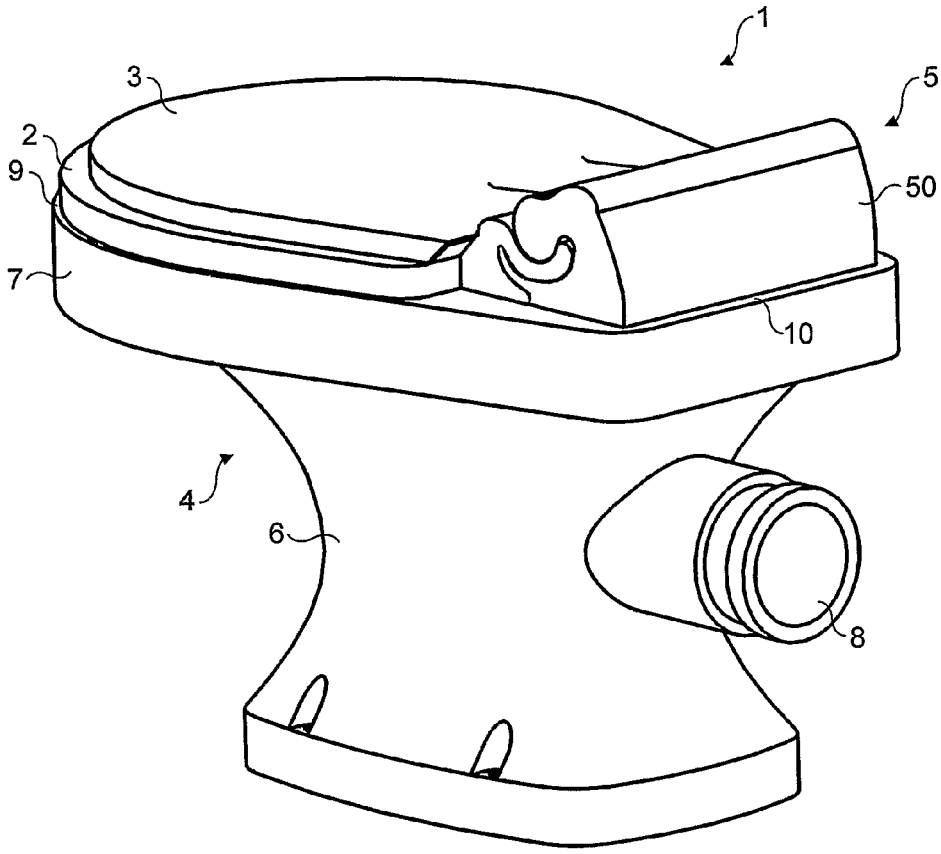
FIG. 1 is a perspective view of a toilet seat and lid assembly according to the present invention.
Figure 2:
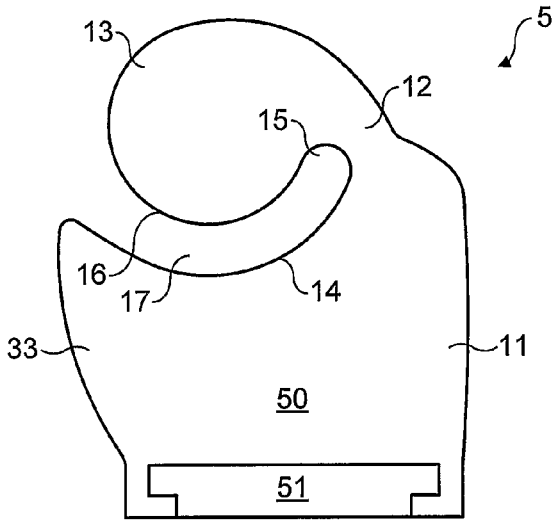
FIG. 2 is an end elevation of a mounting block of a hinge of the assembly of FIG. 1.
Figure 3A:
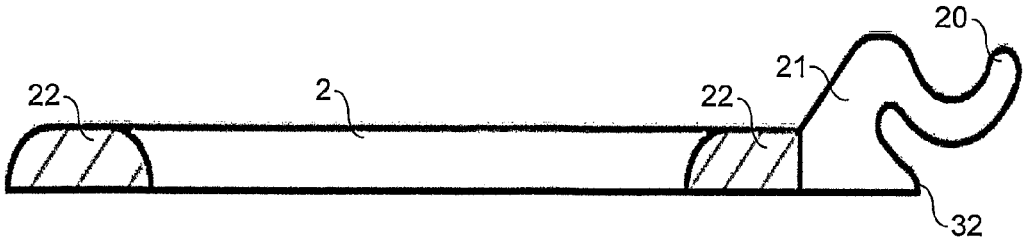
Figure 3B:
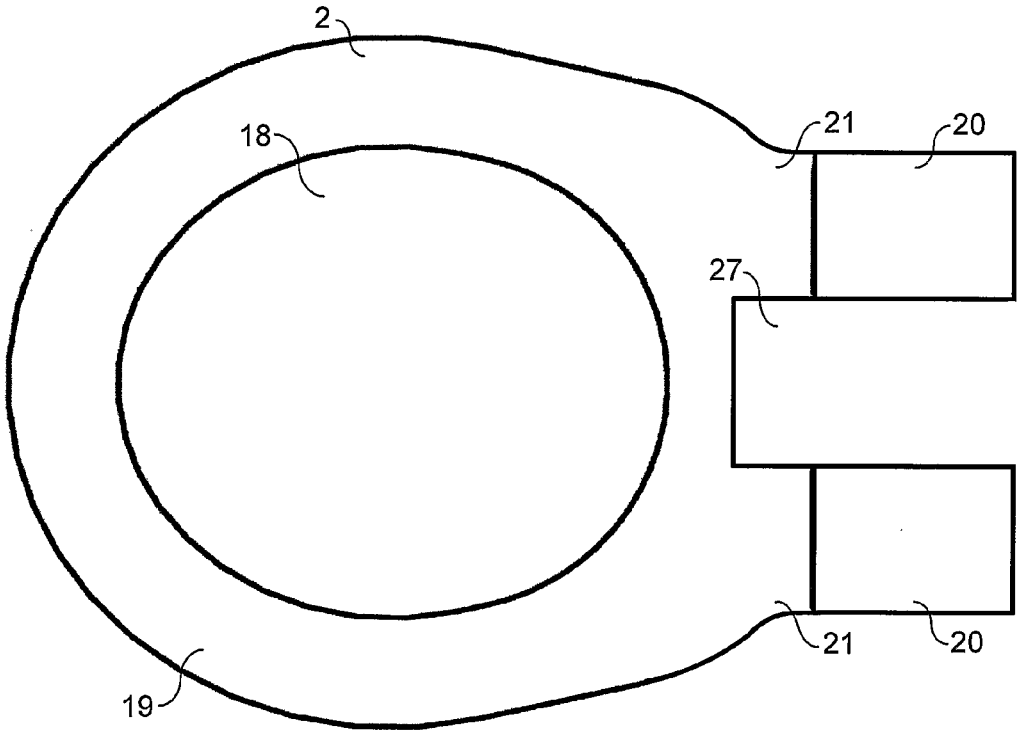

FIG. 3*a* is a side elevation of the seat of the assembly of FIGS. 1 and 2;

FIG. 3*b* is plan view of the seat of FIG. 3*a;*

Figure 4A:
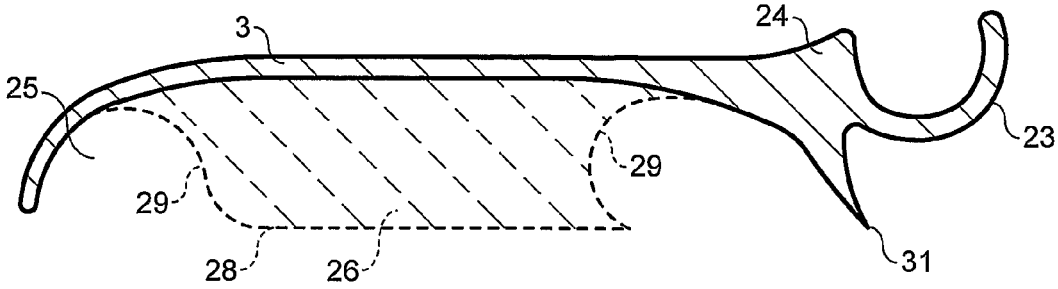
Figure 4B:
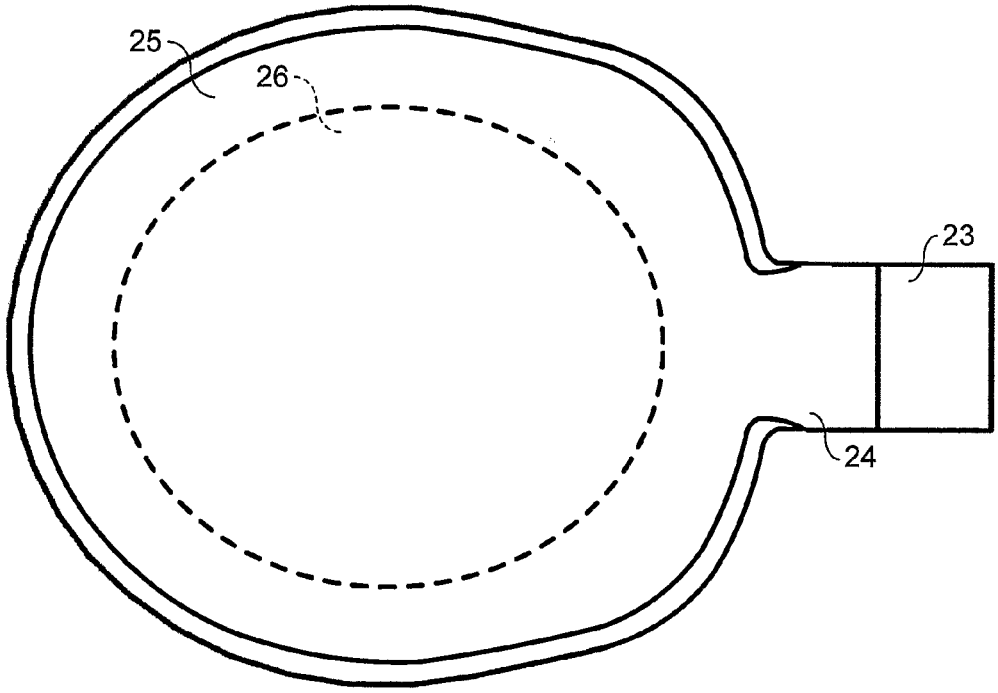

FIG. 4*a* is a cross-section through the lid of the present invention;

FIG. 4*b* is plan view of the lid of FIG. 4*a;*

Figure 5:
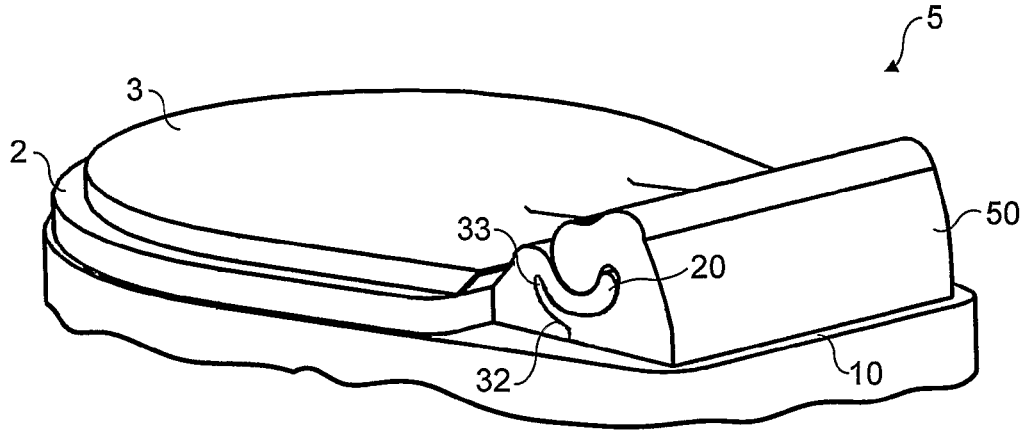
Figure 6:
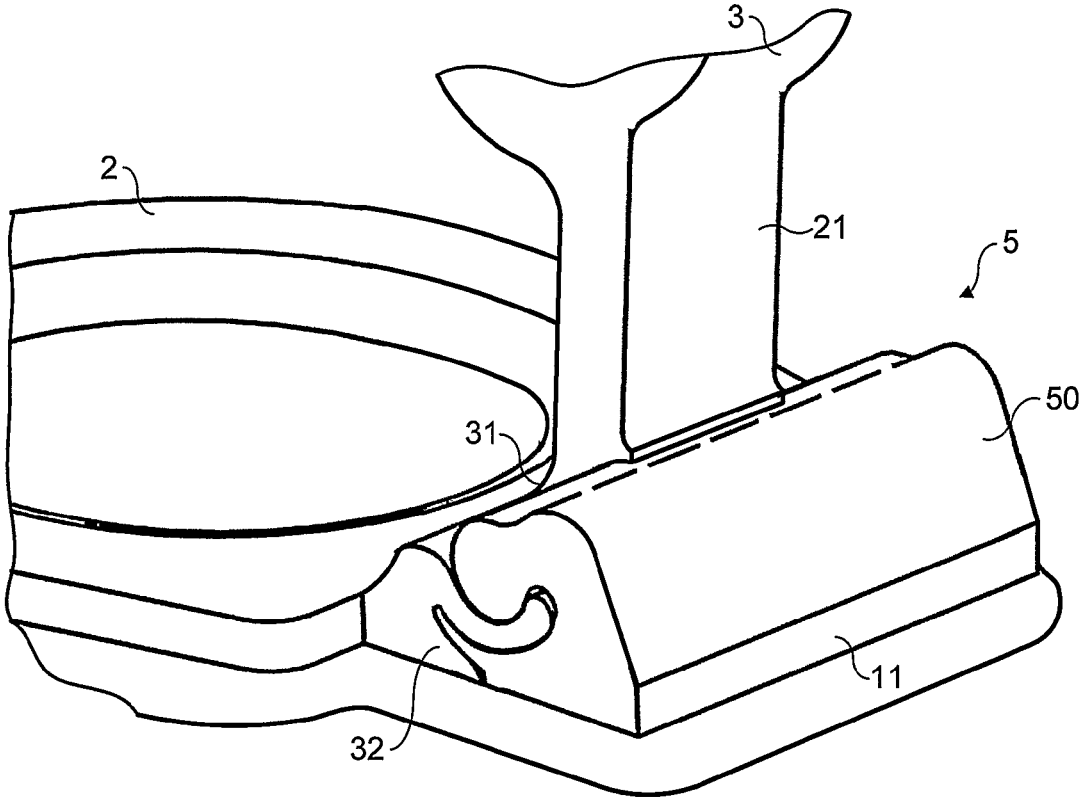
Figure 7:
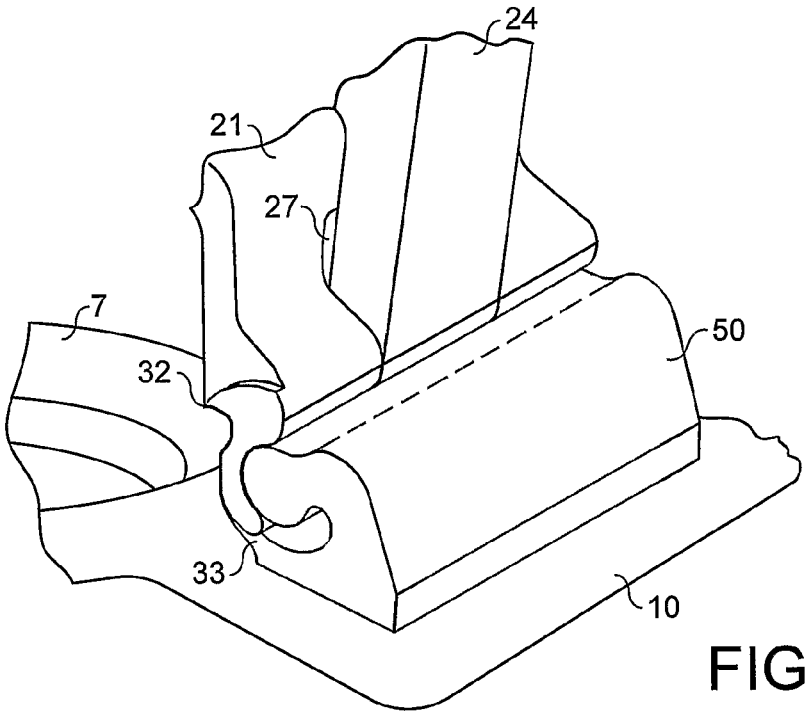
Figure 8:
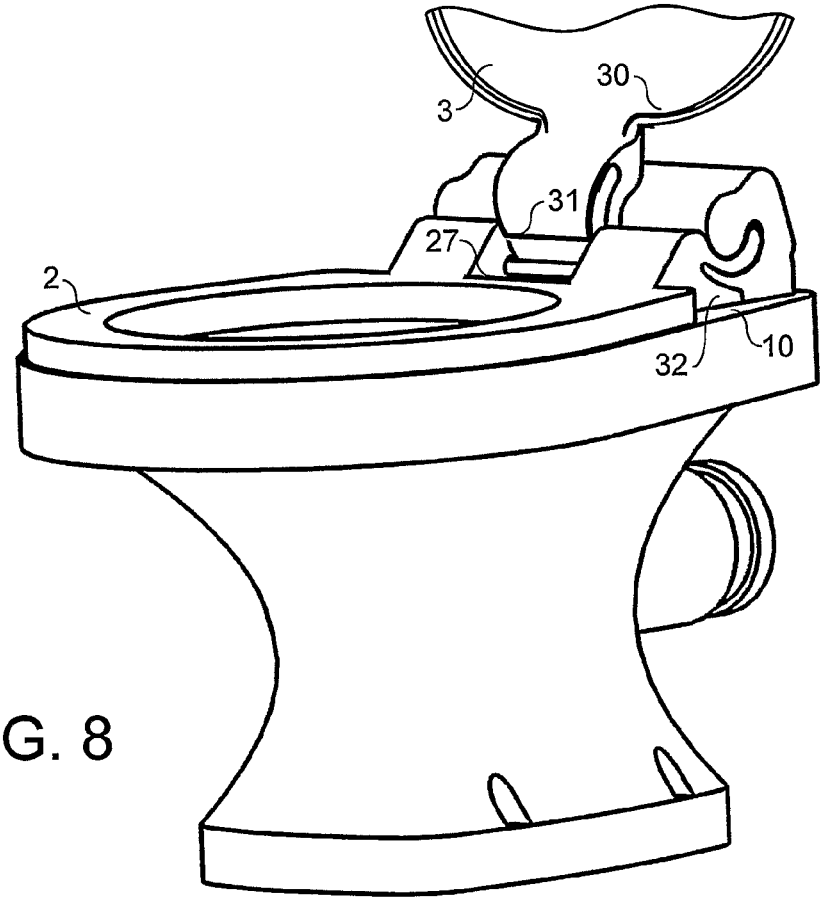

FIG. 5 is a perspective view of the toilet seat and lid assembly of FIG. 1 in a closed state;

FIG. 6 is a perspective view of the toilet seat and lid assembly of FIG. 1 with the lid open and the seat down; and FIG. 7 is a perspective view of the toilet seat and lid assembly of FIG. 1 with the set and lid both in the up position;

FIG. 8 is a perspective view of the toilet seat and lid assembly of FIG. 1 with the lid open and the seat down.

As shown in FIG. 1, a toilet seat and lid assembly 1 of a preferred embodiment of the present invention provides a hinge 5 to attach a seat 2 and a lid 3 to a standard toilet 4. The hinge 5 allows the seat 2 and lid 3 to be raised and lowered. The hinge 5 is also easy to clean. The seat 2 and lid 3 are designed to minimise build-up of dirt. The hinge 5 allows the seat 2 and lid 3 to be detached to permit access to every surface for cleaning.

In FIG. 1, the seat 2 rests on the toilet 4, and the lid 3 is closed. The hinge 5 allows either the lid 3 to be raised on its own to an upright position, or both the seat 2 and lid 3 to be rotated to an upright position.

The toilet 4 is formed of a bowl 6, with a rim 7 located on the top of the bowl 6. The bowl 6 is plumbed into a mains water supply to receive water, and is plumbed into a mains waste pipe 8 through a pipe 8 for waste to be removed. The pipe 8 defines a rearward direction. The toilet 4 can 'flush' in a conventional manner in order to remove excreta, and introduce fresh water into the bowl 6. The rim 7 forms the top of the toilet base unit 4. The upper surface 9 of the rim 7 is a substantially flat elliptical planar surface surrounding the bowl 6. At the rear end of the toilet base unit 4, the upper surface 9 widens away from the bowl 6 to form a rectangular horizontal surface, termed the mounting surface 10.

As shown in FIG. 2, the hinge 5 comprises a mounting block 50 which is an elongate prism of uniform cross-section. The mounting block 50 is securely fastened to the mounting surface 10 of the toilet base unit 4 and is orientated with a long side tangential to the rim 7 of the bowl 6. The mounting block 50 comprises a single piece of material, which is preferably manufactured by extrusion. The mounting block 50 has a body 11, a neck 12 and a head 13.

The body 11 is fastened to the mounting surface 10 of the toilet base unit 4 by a suitable mechanical fastening. The body 11 has a T-shaped slot 51 extending therethrough which enables the block 50 to be slid into engagement with a detent (not shown) secured to the mounting surface 10.

The neck 12 connects the body 11 to the head 13. The neck 12 joins the body 11 on the upper surface of the body 11, on the rearward side of the body 11 furthest from the bowl 6. The neck 12 has a small cross-section which means that it can be deformed elastically.

The head 13 of the mounting block 5 is held above the body 11 by the neck 12, and spaced apart from the body 11 by the neck 12. The neck 12 joins the head 13 at the rearward side of the head 13. The head 13 is substantially circular in cross-section.

An arcuate channel 17 is formed in the block 50. The channel 17 opens on the forward surface of the mounting block 50, closest to the bowl 6. The arcuate channel 17 has its lowest point approximately a third of the way back from the forward edge of the mounting block 50.

The arcuate channel 17 is large enough to allow cleaning along its length with a hand-held cloth. A preferred width of the arcuate channel 17 would be approximately 15 mm to 25 mm. This dimension is constant along the length of the arcuate channel 17.

The mounting block 50 has a portion 33 which extends in a forward direction beyond the footprint of the mounting block 50.

As shown in FIGS. 3*a* and 3*b*, the seat 2 is substantially elliptical and planar in shape, with an elliptical aperture 18 in its centre. The seat 2 has a support surface 19 around the aperture 18 to support a user in a seated position.

The seat 2 has two identical spaced apart seat tangs 20 which form part of the hinge 5. The seat tangs 20 are each arcuate and curve upwardly out of the plane of the seat 2 to form a U-shape when viewed in side elevation. The thickness of each seat tang 20 is substantially the same as the depth of the channel 17 and the radius of curvature of the arcuate seat tangs 20 is substantially the same as that of the arcuate channel 17.

Each seat tang 20 is connected to the seat 2 by a seat arm 21 and the seat arms 21 and seat tangs 20 are integrally formed with the seat. The seat tangs 20 are attached to the distal end of each seat arm 21. The seat arms 21 are spaced apart, and extend rearwardly and upwardly out of the plane of the seat 2. The seat arms 21 extend parallel to one another rearwardly and extend from the rearward side of the seat 2.

The seat arms 21 each have a lower surface which tapers rearwardly to an edge 32. The tapering arms 21 fit snugly under the portion 33 of the mounting block 50 when the seat 2 is in a down position.

When the seat 2 is in an upright position, the edge 32 directs splashes into the bowl 6. This assists in keeping the hinge 5 clean.

As shown in FIGS. 4*a* and 4*b*, the lid 3 is substantially elliptical in shape and is similar in area to the outer edge of the rim 7 of the bowl 6. The lid 3 comprises a lid tang 23 which forms part of the hinge 5. The lid tang 23 is arcuate and curves upwardly out of the plane of the lid 3. The lid tang 23 is U-shaped when viewed in side elevation. The thickness of the lid tang 23 is substantially the same as the height of the channel 17, and the radius of curvature of the arcuate lid tang 23 is substantially the same as that of the arcuate channel 17.

The lid tang 23 is attached to the lid 3 by a lid arm 24 and the lid arm 24 and lid tang 23 are integrally formed with the lid 3. The lid tang 23 is attached to the distal end of the lid arm 24. The lid arm 24 extends rearwardly from the lid 3, in the plane of the lid 3.

The top surface of the lid 3 is substantially planar, and resembles a conventional toilet lid. The bottom surface of the lid 3 differs from a conventional toilet lid. The lower surface of the lid 3 around the periphery of the lid 3 has a channel 25 shaped to correspond to the support surface 19 of the seat.

The peripheral channel 25 surrounds a central area 26 of the lid 3 which corresponds in shape to the elliptical aperture in the seat 2. The lower surface 28 of the central protrusion 26 is substantially flush with the lower surface of the seat 2, when the lid 3 and seat 2 abut each other. Thus any splashes incident on the surface 28 when the seat 2 and lid 3 are in the upright position are guided into the bowl 6. The two seat arms 21, the rear edge of the seat 2 and the seat tangs 20 together define an aperture 27. The aperture 27 and under-side profile of lid 3 allows splashes and excreta on the lid 3 to drain into the toilet bowl 6 through the aperture 27 when the seat 2 is in the down position. This reduces the amount of dirt retained on the seat 2 and lid 3 and the amount which drains onto the hinge 5 and the mounting surface 10 therebelow.

The channel 25 of the lid 3 has angled side walls 29 so that when the lid 3 is in an upright position, the side walls 29 angle downwardly towards the lower surface 28. This ensures that any splashes, and in particular urine, contacting the underside of the lid 3 will readily flow off and into the bowl 6. The channel 25 also serves to direct all flow to the aperture 27.

The lid arm 24 has a lower surface which tapers rearwardly to an edge 31. The tapering arms 24 fit snugly under the portion 33 of the mounting block 50 when the lid 3 is in a down position.

When the lid 3 is in an upright position and the seat 2 is down, the edge 31 directs any splashes, and in particular urine, into the aperture 27. This assists in keeping the hinge 5 clean.

As shown in FIG. 8, the underside of the lid 3 is profiled with contours 30 to direct any splashes towards the lower, central portion of the lid and into the aperture 27. The lid 3 can be shaped and positioned to be in close proximity to the seat 2 and hinge 5. This assists in keeping the hinge 5 clean.

In a first state shown in FIG. 5, the seat 2 rests on the rim 7 of the toilet 4. The lid 3 rests on top of the seat. Both the seat 2 and the lid 3 are firmly held in place by virtue of the fact that a large part of each tang lies rearward of the lowest point of the arcuate channel 17.

The lid 3 can be rotated from its horizontal position, through an angle of slightly more than 90 degrees, to a substantially upright position. In this second state, shown in FIG. 6, the lid 3 is supported in the upright orientation by a rest (not shown) at an angle to the vertical. As the lid 3 rotates about the hinge mechanism, the lid tang 23 slides within the U-shaped channel 17. The curvature of the lid tang 23 and the channel 17 mean that the movement of the lid tang 23 along the channel 17 results in the rotation of the lid 3 about the head 13 of the mounting block 5.

The seat 2 can also be lifted from a horizontal position to an upright position. With the lid 3 previously or simultaneously lifted into an upright position, the seat 2 can be rotated through slightly more than 90 degrees. In this third state, shown in FIG. 7, the seat 2 is supported in the upright position by the lid 3 at an angle to the vertical. As the seat 2 rotates about the hinge mechanism, the seat tangs 20 slide within the U-shaped channel 17. The curvature of the tangs and the channel 17 mean that the movement of the seat tang 20 along the channel 17 results in the rotation of the seat 2 about the head 13 of the mounting block 5. When the seat 2 and lid 3 are in the upright position, the seat tangs 20 and lid tang 23 are still held in the channel 17 of the mounting block 5.

The lid 3 and seat 2 can be easily removed in order to clean them and to clean the channel 17 of the mounting block 50. The seat 2 and lid 3 are first raised to their upright positions. This means that only a small part of each of the tangs lies rearward of the lowermost part of the channel 17 and the seat 2 and the lid 3 can then easily be removed by pulling the seat 2 and the lid 3 in a forward direction. Elastic deformation of the mounting block 50 and the tangs permits this.

The seat 2 and lid 3 could also be removed by rotation. The seat 2 and lid 3 are first raised into the upright position. Typically, they are prevented from over-rotating past the upright position by a backrest. If the backrest is removed or absent, e.g. if the mounting block 50 is twisted so that the backrest no longer lies behind the seat and lid then the seat 2 and lid 3 can be further rotated until the lid tang 23 and seat tangs 20 have slid out of the channel 17 of the mounting block 5. The mounting block 5 and tangs do not have any features to prevent the tangs rotating clear of the mounting block 5, and so the lid 3 and seat 2 can be quickly removed.

The mounting block 5 has been described as comprising a channel 17 which extends through the mounting block 5, the channel 17 open to the front and to both sides. This could allow removal of the lid 3 and seat 2 by sliding the seat tangs 20 and cover tang 23 sideways out of the mounting block 5. However this could give problems with secure location of the seat and lid in their lowered positions. Thus, in an alternative embodiment, side plates could be attached to the mounting block 5 extend over the channel 17. The side walls of the mounting block 5 will thus be in contact with the seat tangs 20. This prevents the seat tangs 20 from sliding sideways out of the mounting block 5. Since the lid tang 23 is located in the channel 17 between the two seat tangs 20, the lid tang 23 also cannot slide out of the mounting block 5 of this embodiment.

In another embodiment, the lid 3 is secured in the mounting block 5 by means of a dowel rod. The lid tang 23 is provided with a tang slot, which extends centrally in the plane of rotation of the tang. The tang slot preferably extends through the entire thickness of the tang. The head 13 of the mounting block 5 has an aperture, which extends vertically through the head 13. The aperture and tang slot are aligned, such that the aperture is adjacent to a section of the tang slot throughout the movement of the lid tang 23. A dowel is inserted through the aperture in the head 13, and into the tang slot in the lid tang 23. The aperture and the width of the tang slot are only slightly larger than the dowel, and so the dowel prevents any substantial sideways movement of the lid tang 23. When the lid is rotated, then the dowel slides along the slot. The two seat tangs 20 are located either side of the lid tang 23, and so they also cannot move sideways when the lid tang 23 is held in position. The dowel therefore maintains the lid 3 and seat 2 securely attached to the mounting block 5. The dowel can be easily removed in order to allow the seat 2 and lid 3 to be detached from the mounting block 5.

In another embodiment, the lid tang 23 could be interleaved with the seat tang 20. The lid tang 23 would form a radially inner arcuate member, surrounded over at least part of its length by the seat tang 20 forming a radially outer arcuate member. The seat tang 20 forms an arcuate channel in which the lid tang 23 can slide. The seat tang 20 and lid tang 23 can slide together in the arcuate channel 17.

Above the tangs are described formed integrally with the seat and the lid but they could be formed separately and attached to the seat and the lid. This may be the case if the seat and lid are made of wood and it is preferred to make the hinge components out of plastic. However, the simplicity of the design means that the manufacture of the hinge components from wood is not precluded.

The mounting block 50 is preferably formed by cutting a section from an extrusion of a longer length. This means that different length mounting blocks can be easily obtained from a single extrusion. However, moulding is also a possibility (in which case side plates covering the ends of the arcuate channel 17 could be moulded in features). The hinge components are preferably plastics components, but could be metal.

Above a toilet lid and seat assembly is described. However, in some circumstances (e.g. in public conveniences) toilets are provided only with a seat and are not provided with a lid. The invention can be applied in such circumstances, with the seat only provided with a tang.

The mounting block described above could be split into two or more separate sections all assembled together on a toilet bowl.

The invention claimed is:

1. A toilet seat assembly comprising:

a seat; and hinge means for hingedly attaching the seat to a toilet having a toilet bowl rim, wherein:

the hinge means comprises:

a mounting block having an arcuate slot with a depth and a radius of curvature;

an arcuate seat tang with a thickness and a radius of curvature, said arcuate seat slot extending rearwardly of the seat which is slidable in the arcuate slot of the mounting block, wherein:

the thickness of the arcuate seat tang and the depth of the arcuate slot are substantially the same; and the radius of curvature of the arcuate seat tan and the radius of curvature of the arcuate slot are substantially the same.

2. A toilet seat assembly as claimed in claim 1 further comprising a lid; and hinge means for hingedly attaching the lid to a toilet, said hinge means comprising the mounting block and an arcuate lid tang extending rearwardly of the lid which is also slidable in the arcuate slot of the mounting block.

3. A toilet seat assembly as claimed in claim 2 wherein the seat has a plurality of seat tangs each slidable in the arcuate slot and sandwiching therebetween the lid tang.

4. A toilet seat assembly as claimed in claim 3 wherein when the seat is in a down position thereof overlying a rim of a bowl of a toilet and the lid is in an up position tilted upwardly away from contact with the seat, then the seat defines an aperture which is located between the seat tangs and the mounting block and which is located above the toilet bowl, the aperture permitting flow into the toilet bowl of any material falling onto a lower surface of the lid.

5. A toilet seat assembly as claimed in claim 4 wherein the lid has a lower surface which is profiled to direct liquid incident on the lid in the up position into the aperture.

6. A toilet seat assembly as claimed in claim 2 wherein the lid has a lower surface with a peripheral recess which matches the toilet seat and receives the toilet seat when the seat and lid abut each other and wherein the lid has a central portion which lies substantially flush with a lower surface of the seat when the seat and the lid abut each other.

7. A toilet seat assembly as claimed in claim 6 wherein the peripheral recess has wall surfaces angled to direct downwardly any liquid impinging on the lid when the lid is in the upper position.

8. A toilet seat assembly as claimed in claim 1 wherein the mounting block has a component formed from an extrusion and the arcuate slot extends completely through the extruded component.

9. A toilet seat assembly as claimed in claim 2 wherein:

the seat and lid tangs and/or the mounting block have flexibility; and when the seat and lid are in up positions thereof, hingedly pivoted away from the toilet bowl rim, then the seat and lid tangs extend into the arcuate slot to a first extent; and when the seat and lid are in down positions thereof, overlying toilet bowl rim, then the seat and lid tangs extend into the arcuate slot by a second extent, greater than the first extent; and when the seat and lid tangs extend into the arcuate slot by the second extent then they hold the seat and lid firmly in place and provide significant resistance to withdrawal of the seat and lid tangs from the arcuate slot; and when the seat and lid tangs extend into the arcuate slot by the first extent thereof then the flexibility of the tangs and/or the mounting block allows withdrawal of the tangs from the arcuate slot by application of a force to the seat and lid in a direction perpendicular to a hinge axis thereof.

10. A toilet seat assembly as claimed in claim 1 wherein the mounting block comprises a plurality of separate sections.

11. A toilet seat assembly comprising:

a seat; and hinge means for hingedly attaching the seat to a toilet; wherein:

the hinge means comprises:

a mounting block having an arcuate tang with a thickness and a radius of curvature;

an arcuate seat slot with a depth and a radius of curvature, said arcuate seat slot extending to the rear of the seat which is slidable around the arcuate tang of the mounting block, wherein:

the thickness of the mounting block arcuate tang and the depth of the arcuate seat slot are substantially the same; and the radius of curvature of the mounting block arcuate tang and the radius of curvature of the arcuate seat slot are substantially the same.

12. A toilet seat assembly as claimed in claim 11 comprising additionally:

a lid; and an arcuate lid slot extending rearwardly of the lid which is also slidable around the arcuate tang of the mounting block.

13. A toilet seat as claimed in claim 12 wherein the lid has a lower surface which is profiled to direct liquid incident on the lid in the up position into the aperture.

14. A toilet seat assembly as claimed in claim 12 wherein the lid has a lower surface with a peripheral recess which matches the toilet seat and receives the toilet seat when the seat and lid abut each other and wherein the lid has a central portion which lies substantially flush with a lower surface of the seat when the seat and the lid abut each other.

15. A toilet seat assembly as claimed in claim 14 wherein the peripheral recess has wall surfaces angled to direct downwardly any liquid impinging on the lid when the lid is in the up position.

16. A toilet seat assembly as claimed in claim 12 wherein:

the arcuate tang of the mounting block is flexible; and when the seat and lid are in up positions thereof, hingedly pivoted away from a bowl rim of the toilet, then the arcuate tang extends into the arcuate slots of the seat and lid by a first extent; and when the seat and lid are in down positions thereof, overlying the toilet bowl rim, then the arcuate tang extends into the arcuate slots of the seat and lid by a second extent, greater than the first extent; and when the arcuate tang extends into the arcuate slots by the second extent then the tang holds the seat and lid firmly in place and provides significant resistance to withdrawal of the arcuate tang from the arcuate slots; and when the arcuate tang extends into the arcuate slots by the first extent thereof then the flexibility of the tang allows withdrawal of the tang from the arcuate slots by application of a force to the seat and lid in a direction perpendicular to a hinge axis thereof.

* * * * *